United States Patent [19]

Ellis

[11] 4,341,498

[45] Jul. 27, 1982

[54] METHOD AND APPARATUS FOR BLANKING, FOLDING AND INSERTING MEMBRANE INTO CONTAINER COVERCAP

[75] Inventor: Darwin L. Ellis, Richmond, Ind.

[73] Assignee: Aluminum Company of America, Pittsburgh, Pa.

[21] Appl. No.: 162,149

[22] Filed: Jun. 23, 1980

[51] Int. Cl.[3] ..... B21D 51/46

[52] U.S. Cl. ..... 413/3; 413/9; 413/64

[58] Field of Search ..... 493/58, 62, 93-101; 29/430, 453, 773, 797; 156/262; 425/809; 413/3, 9, 59, 63, 64; 113/1 F, 121 C, 80 D, 80 DA, 121 A, 114 B, 114 C

[56] References Cited

U.S. PATENT DOCUMENTS

| | | | |
|---|---|---|---|
| 1,098,354 | 5/1914 | Nichols | 113/80 D |
| 1,968,904 | 8/1934 | Page | 113/80 D |
| 2,100,596 | 11/1937 | Kronquest . | |
| 2,148,906 | 2/1939 | Jonsson . | |
| 2,901,994 | 9/1959 | Wheeler . | |
| 3,328,873 | 7/1967 | Schweers . | |
| 3,501,045 | 3/1970 | Asmus et al. . | |
| 3,641,959 | 2/1972 | Hurst | 113/80 DA X |
| 3,734,044 | 5/1973 | Asmus et al. | 113/121 C |
| 3,892,351 | 7/1975 | Johnson et al. . | |
| 3,959,061 | 5/1976 | Renck et al. | 113/80 DA X |
| 3,961,566 | 6/1976 | Westphal et al. . | |
| 4,047,473 | 9/1977 | Fletcher et al. . | |
| 4,295,436 | 10/1981 | Zangari et al. | 113/80 D |

*Primary Examiner*—Mark Rosenbaum
*Attorney, Agent, or Firm*—Max L. Williamson

[57] ABSTRACT

A method and apparatus for blanking, folding and inserting induction heat sealable membranes, having a disc and integral tab portion, in container covercaps in one continuous punch stroke. The tab portion is blanked from foil stock and folding of the tab is initiated during tab blanking along a fold line located at the periphery of the disc portion. The disc portion of the membrane is then blanked while continuing to fold the tab portion to an intermediate reverse folded position. The blanked membrane is then inserted into an overcap to press the tab between the membrane disc portion and the covercap to further fold the tab along the fold line.

20 Claims, 11 Drawing Figures

FIG. 1.
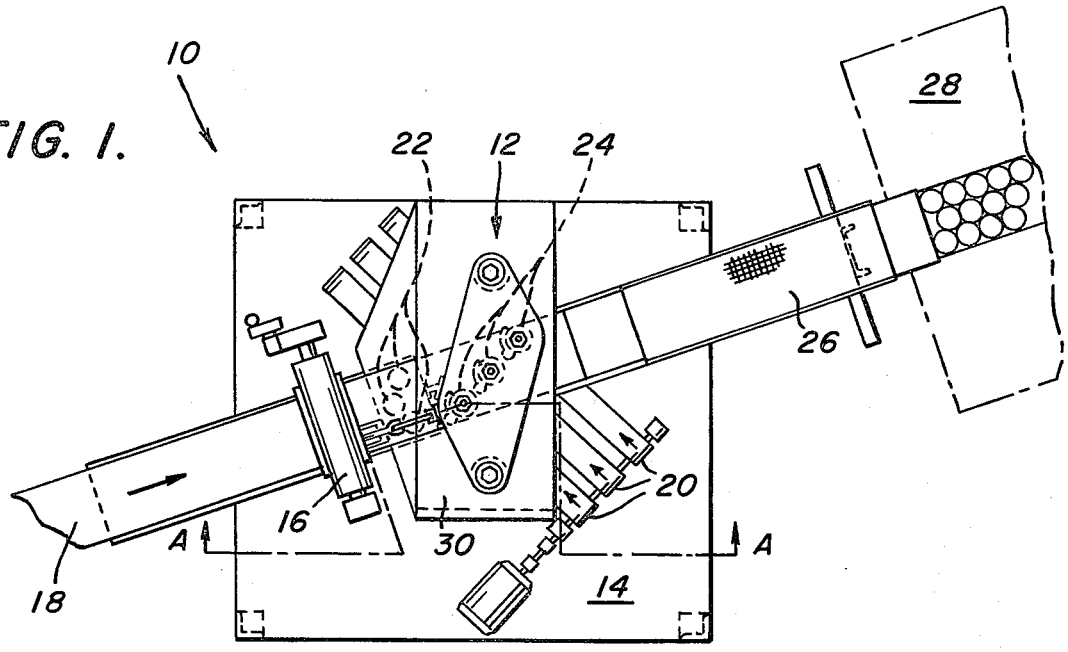
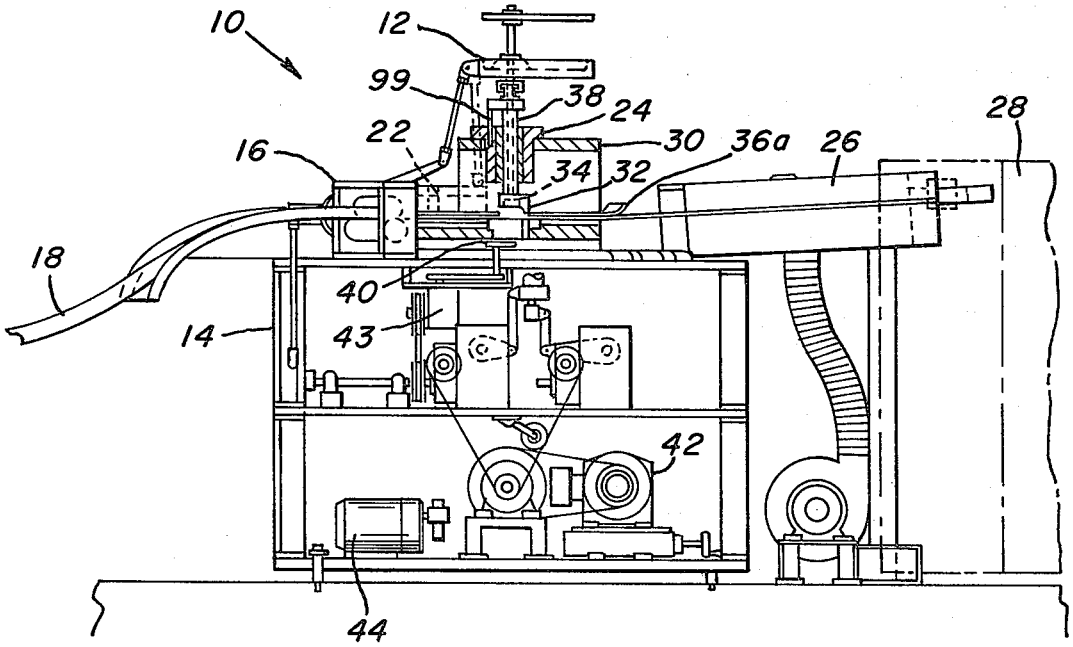
FIG. 2.

METHOD AND APPARATUS FOR BLANKING, FOLDING AND INSERTING MEMBRANE INTO CONTAINER COVERCAP

BACKGROUND OF THE INVENTION

This invention relates to a method and apparatus for blanking and inserting foil membranes into reusable covercaps. More particularly, the invention relates to a method and apparatus for automatically inserting coated aluminum foil membranes into plastic covercaps in one continuous punch stroke by blanking a foil membrane with a pull tab, folding the tab and inserting the membrane into the cap.

Resealable packages, such as food packages, may include a removable sealing membrane and a reusable covercap for reclosing the container after opening. Such containers, which may be metal or composite containers, usually have the removable sealing membrane secured to the mouth of the container by induction heat sealing. Such membranes may include a disc portion and an integral tab portion which may be reverse folded about a line adjacent the periphery of the membrane disc portion and sandwiched between the membrane disc and the covercap. The tab portion facilitates removal of the membrane from the container after removal of the covercap.

It is known in the art to blank disc-shaped metal foil having integral tab portions. U.S. Pat. No. 2,901,994, issued Sept. 1, 1959, discloses an apparatus for making metal foil closure hoods with an integral tear tab. The patent discloses a tab cutting and folding mechanism for precutting the tab and folding it over the top of the foil membrane into the circular area from which the hood is to be made. The tab cutting mechanism, which is provided one feed step ahead of the hood blanking step, includes a hollow punch with a beveled surface and folding fingers. U.S. Pat. No. 2,148,906, issued Feb. 28, 1939, discloses an apparatus for the manufacture of container caps having a finger tab with a pattern for gripping. When the cap blank has been punched out, a punch and female drawing sleeve continue downwardly such that the tab is held sandwiched between two stamping portions of the mechanism during the drawing operation of the container cap.

It is also known in the art to combine blanking of the membrane with insertion of the membrane into a cap. U.S. Pat. No. 2,100,596, issued Nov. 30, 1937, and U.S. Pat. No. 3,959,061, issued May 25, 1976, disclose methods and apparatus for inserting generally disc shaped membranes into container caps wherein the blanking and inserting steps are accomplished in one continuous press stroke.

For membranes having a disc portion and integral tab portion, a precise fold of the tab is necessary in order to achieve a proper induction heat seal. For example, a fold too close to the center of the disc portion of the membrane will cause a "leaker" which can be defined as a membrane that has not been properly sealed entirely around the periphery of the container mouth and which will result in leakage of the container contents from the improperly sealed package. Furthermore, a fold too far from the center of the disc may result in excessive metal at the edge of the disc at the point of induction heat sealing. The excessive metal acts as a heat sink which precludes reaching of the proper bonding temperature and results in either unsealed membranes or membranes that can be accidentally unsealed. U.S. Pat. No. 3,892,351, issued July 1, 1975, discloses an attempt to facilitate uniform heat distribution during the heat sealing step by the use of holes or elongated openings in the region where the tab joins the circular disc portion of the foil membrane. Another patent, U.S. Pat. No. 3,961,566, issued June 8, 1976, shows the use of fold lines to define the tab portion of the membrane in order to facilitate bending of the tab.

Attempts have also been made, as shown in U.S. Pat. Nos. 3,501,045, issued Mar. 17, 1970, and 3,734,044, issued May 22, 1973, to provide easy opening of such containers and to reduce the amount of scrap foil material resulting from blanking membranes from foil stock. It is also known, for example, in U.S. Pat. No. 3,328,873, issued July 4, 1967, and U.S. Pat. No. 4,047,473, issued Sept. 13, 1977, to use a vacuum head to hold a blanked membrane in position before insertion into the covercap.

Such prior art methods and apparatus are not without shortcomings however. There still exists a need to automate blanking and inserting of aluminum foil membranes into plastic covercaps particularly suited for induction heat sealed containers. It is desirous that the blanking and inserting be done simultaneously in one operation, preferably, in one stroke of a blanking punch. Furthermore, the blanking and inserting of multiple membranes in one operation would be further suited for high speed production lines. In order to accomplish such blanking and inserting in one operation, a machine should be able to blank the membrane disc and integral tab portions, to fold the tab accurately without tears to provide good quality membranes for induction heat sealing to containers, and to insert the blanked membrane into covercaps.

SUMMARY OF THE INVENTION

In accordance with the present invention, a method is provided for making a closure assembly of a foil membrane and a covercap by forming a membrane having disc and integral tab portions from foil stock. The method includes initiating blanking of the tab and then reverse folding of the tab along a line at the periphery of the disc portion as the tab is being blanked. The tab is then folded to an intermediate reverse folded position as the disc portion is being blanked. The method further provides inserting the blanked membrane into the covercap to sandwich the tab portion between the membrane disc portion and covercap by pressing the end of the partially folded tab farthest from the fold line against the interior of the covercap. The method blanks, folds and inserts the membrane in one continous stroke of a punch.

An apparatus for making the closure assembly is provided and includes a punch having a projecting finger portion for blanking the membrane tab portion. The finger portion extends laterally from the punch and forward of the punch in the direction of punch travel during blanking. The finger portion initiates blanking of the tab before blanking of the disc and includes a cam surface on the cutting face of the finger for progressively folding the tab in the direction of the punch travel during blanking until folded along a fold line joining the tab with the disc at the periphery of the disc portion. The apparatus includes a means for reversely folding the tab in the direction of punch travel to an intermediate reverse folded position, and a means for inserting the blanked membrane into the covercap including an insertion head nested within the blanking punch. The insertion head separates from the face of the punch and travels axially therefrom for inserting the blanked membrane into the covercap to press the partially folded tab between the membrane disc and the covercap into a reverse fold. The insertion head includes a means for holding the membrane to the face thereof during insertion into the covercap and for thereafter releasing the membrane.

BRIEF DESCRIPTION OF THE DRAWINGS

FIG. 1 is a plan view of an apparatus of the present invention.

FIG. 2 is a side elevation view of the apparatus of FIG. 1 shown in partial cross section.

DETAILED DESCRIPTION OF THE PREFERRED EMBODIMENTS OF THE INVENTION

Figure 3:
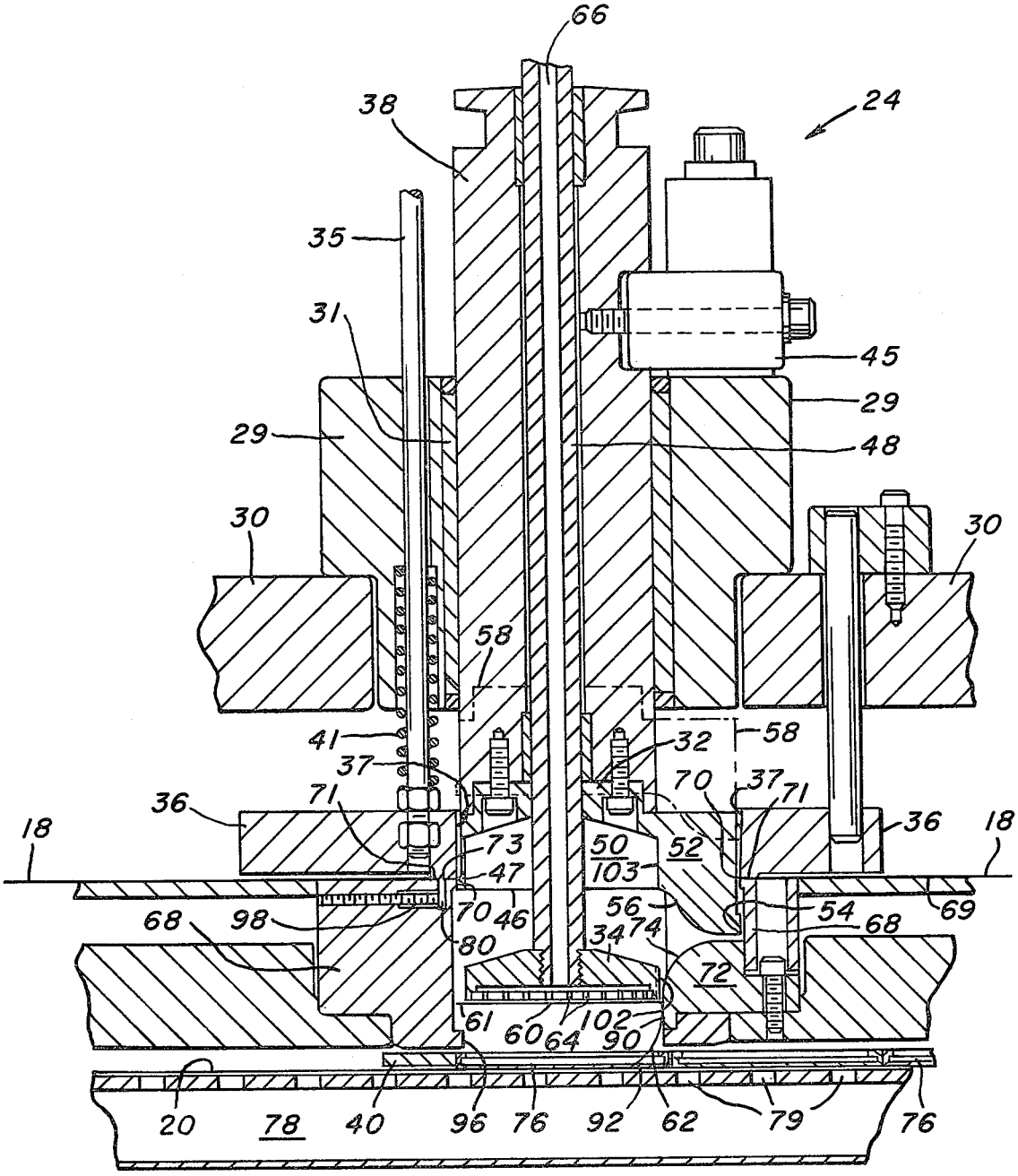
FIG. 3 is a cross-sectional view of a blanking, folding and inserting station of the present invention.

FIG. 1 is a plan view of the apparatus of the present invention illustrating blanking, folding and inserting machine 10 having a subassembly 12 and a housing 14. Subassembly 12 includes embossing stations 22 and multiple blanking, folding and inserting stations 24. A roll feed device 16 incrementally supplies foil stock 18 to embossing stations 22 and then to stations 24. Conveyor 20 supplies covercaps (not shown) to stations 24. Downstream of subassembly 12 is an air conveyor 26 to facilitate movement of foil stock 18 from roll feed device 16 through stations 24 and to scrap container 28 that receives foil stock 18 from which membranes have been blanked.

FIG. 2 is a side elevation view of machine 10 in partial cross section taken along lines A—A of FIG. 1. FIG. 2 further illustrates a single blanking, folding and inserting station 24 of subassembly 12. Station 24 includes a blanking punch 32 having a punch support shaft 38 arranged vertically through a punch bearing support plate 30. Punch 32, located at the lower end of hollow punch support shaft 38, moves downwardly for blanking foil stock 18 which is fed through roll feed device 16 to subassembly 12. Nested within blanking punch 32 is an inserting punch 34 for inserting blanked membranes into covercaps (not shown). Conveyor 20 supplies covercaps into a position subjacent to the foil stock 18 and blanking punch 32. Subassembly 12 may also include a stripper plate 36*a* which is a substantially horizontal member lying above and substantially parallel to the plane of foil stock 18 at the station 24. Stripper plate 36*a* facilitates removal of foil stock 18 from punch 32 after the blanked membrane has been inserted into the covercap and as the inserting and blanking punches 34 and 32, respectively, retract vertically upwards above the plane of foil stock 18.

FIG. 2 further illustrates housing 14 including means for powering machine 10. The means includes various motors and pumps for actuating the various moving members of subassembly 12 of blanking, folding and inserting machine 10. A driving motor 42, such as a five horsepower alternating current motor having a maximum 1,725 rpm, provides power to subassembly 12 through a series of gear trains, clutches, reducers and oscillators. Vacuum pump 44 may also be used for supplying a vacuum source to subassembly 12.

FIGS. 1 and 2 show embossing tools 22 upstream ahead of stations 24, which may be provided to emboss designs, symbols, wording or the like on the foil stock before it is blanked into membranes for insertion into covercaps. Roll feed device 16, which is located ahead of stations 24 and embossing tools 22, may be a conventional device for supplying foil stock. As shown, roll feed device 16 may include two rollers between which foil stock is received as each roller rotates about its axis for incrementally feeding foil stock 18 into station 24.

FIG. 3 is an enlarged detailed cross section of a preferred embodiment of blanking, folding and inserting station 24 of the present invention shown in FIG. 2. However, stripper plate 36, shown in FIG. 3, differs structurally from stripper plate 36*a* of FIG. 2 in a manner which is later set forth in the description relative to FIG. 4.

FIG. 3 generally shows the substantially parallel arrangement of punch support plate 30, stripper plate 36, foil stock 18, conveyor 20 and the cutting plane defined by top surface 69 of base blanking die 68 at station 24. Stripper plate 36 is substantially parallel to punch support plate 30 and located subjacent thereto. Foil feed stock 18 is substantially parallel to stripper plate 36 and punch support plate 30 and located below and adjacent stripper plate 36. Conveyor 20 is located below and substantially parallel to foil stock 18, as well as, parallel to stripper plate 36 and punch support plate 30.

Punch support shaft 38 and punches 32 and 34 are illustrated as being substantially perpendicular to punch support plate 30, stripper plate 36, foil stock 18 and conveyor 20. Preferably, punch support plate 30 includes a bearing housing 29 and support shaft bearing 31 through which punch support shaft 38 is slidably arranged. Bearing housing 29 may be laterally and rotatably movable to permit adjustment and alignment of the cutting edges of blanking punch 32 with those of base blanking die 68.

Stripper plate 36 facilitates removal of foil stock 18 that may remain frictionally attached to the periphery of punch 32 as it is retracted through foil stock 18 after insertion of blanked membrane 60. Stripper plate 36, which may be movable or stationary, has sidewall 37 defining a hole therein having substantially the same shape as blanking punch 32 and as the die opening of blanking die 68 defined by cutting edge 70. The hole is sized larger than but in close tolerance with blanking punch 32 which moves within the hole during blanking. Preferably, stripper plate 36 is movable over a short travel axially with respect to punch 32. Stripper plate 36 is secured to stripper support shaft 35 which is arranged with its axis passing through punch support plate 30 in a manner substantially parallel to punch support shaft 38.

Movement of stripper plate 36 preferably is facilitated by the arrangement of stripper support shaft 35 with biasing means, such as spring 41. Preferably, with the spring in a prestressed, compressed or preloaded condition, the lower substantially planar surface portion 71 of stripper plate 36 contacts with and presses on surface 69 of blanking die 68. Preferably, surface portion 71 of stripper plate 36 extends substantially about the entire periphery of the hole therein defined by sidewall 37. Axial movement of stripper plate 36 away from surface 69 of die 68 and toward punch support plate 30 further compresses spring 41. Alternatively, spring 41 may be in an uncompressed or relaxed condition when stripper plate 36 contacts with and rests on surface 69 and is thereafter compressed.

Figure 4:
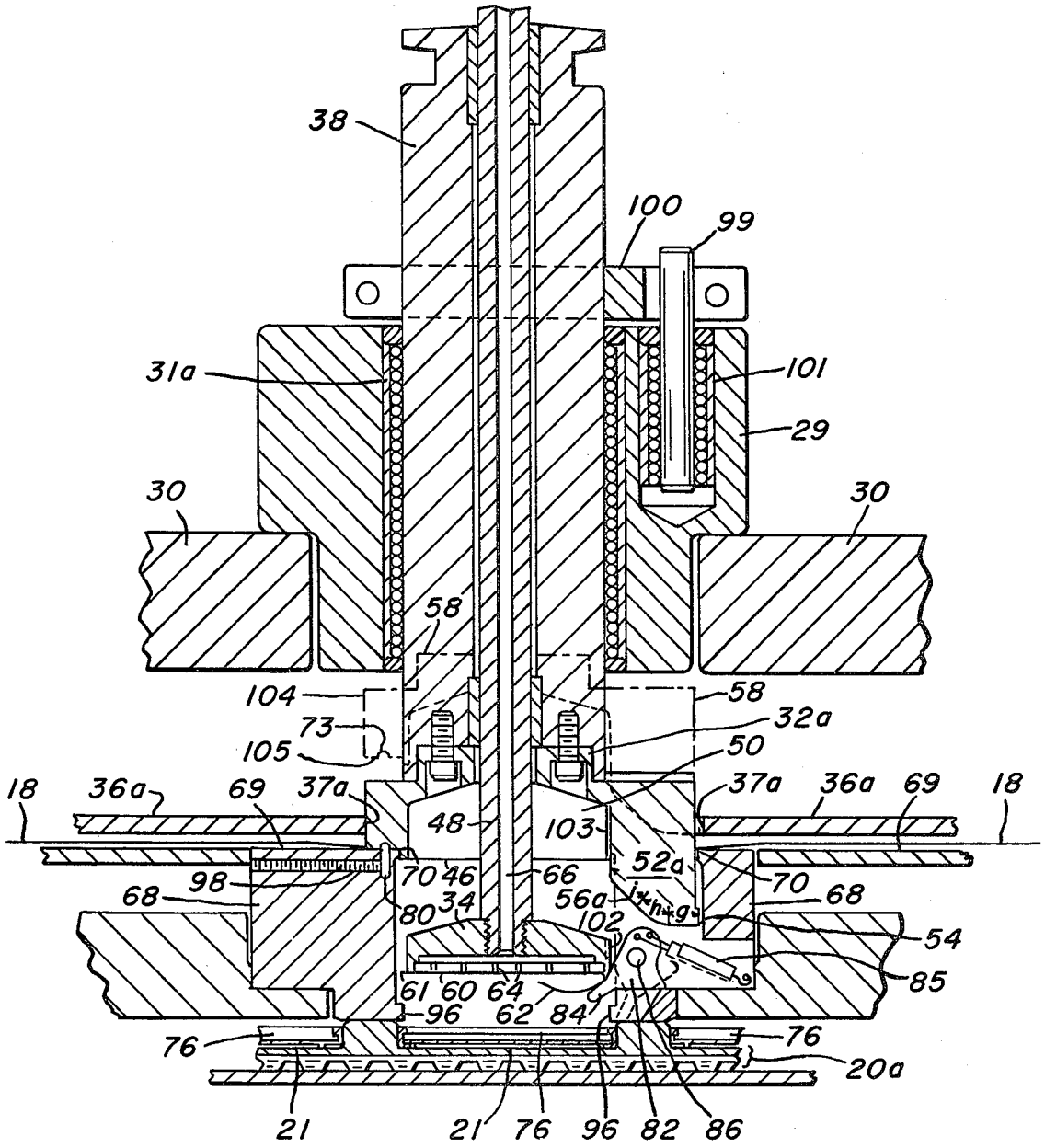
FIG. 4 is a cross-sectional view of alternative embodiments of FIG. 3.

In the alternative, stripper plate **36*a* may be stationary, as shown in FIG. 4. Stripper plate 36*a* includes a hole therein defined by sidewall 37*a* and having substantially the same shape as blanking punch 32*a*, which moves within the hole of stripper plate 36*a* during blanking. The hole is slightly larger than blanking punch 32*a* to permit sliding movement of punch 32*a* through the hole. Stripper plate 36*a* is secured in a fixed position spaced above the cutting plane of the surface 69 of blanking die 68. Foil stock 18 passes through the surface between stripper plate 36*a* and surface 69 of blanking die 68**.

At the bottom end of punch support shaft 38 is blanking punch 32. An axially movable inserting punch head 34, which nests within cavity 50 on the face of blanking punch head 32, is connected to the bottom end of shaft 48 which extends along the axis of punch support shaft 38. Inserting head 34 is slidably arranged within punch support shaft 38 for axial movement of shaft 48 within punch support shaft 38. Blanking punch 32 further includes a projecting finger portion 52 extending laterally from the main portion of the punch and forward of the punch in the direction of punch travel during blanking. Cutting edge 46 about the face of punch 32 and cutting edge 54 about projecting finger portion 52 facilitate blanking of foil stock membranes.

In FIG. 3, projecting finger 52 includes cutting edge 54 for initiating blanking of the tab when blanking a membrane from the foil stock 18. Finger 52 includes a camming surface 56 for initiating folding of the tab during blanking. Cam surface 56 may take various shapes and forms, so long as cam surface 56 of finger 52 initiates folding and progressively folds the tab portion 62 during blanking of membrane 60. Preferably, cam surface 56 includes a substantially planar first stage section "a" merging into a convex second stage section "b" which merges into a concave third stage section "c", as shown in FIG. **5*a*. The first stage section "a" of cam surface 56, is farthest from the axis of punch 32, initiates blanking of the tab and is substantially parallel to the plane of foil stock 18. The planar first stage section merges into the convex second stage section "b" of cam surface 56 at a location closer to the axis of blanking punch 32. The convex second stage section merges into concave third stage section "c" of cam surface 56 of finger 52 at portions closest to the axis of blanking punch 32**.

FIG. 3 further illustrates punch 32 (and projecting finger portion 52) in a full downward position below the plane of foil stock 18 such as after membrane 60 is blanked from foil stock 18. A completely retracted position of punch 32 and projecting finger portion 52 is shown by dotted lines 58 where the entire punch 32 and all portions of finger portion 52 are located above cutting plane 69 of die 68, above the plane of foil strip 18 and within the hole of stripper plate 36 defined by sidewall 37. Inserting punch head 34 nests within cavity 50 of blanking punch 32 during the downward blanking stroke from a completely retracted position until a membrane is blanked.

Figure 7:
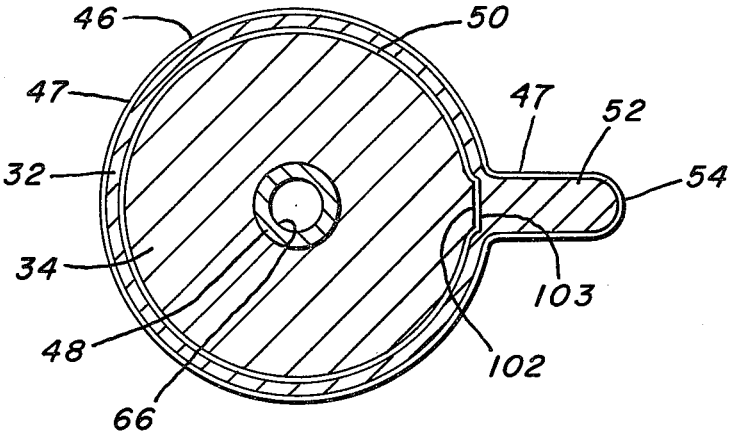
FIG. 7 is a cross-sectional view of blanking and inserting punches of FIG. 5*a*.

Further illustrated in FIG. 7 is the nested arrangement of inserting head 34 in blanking punch 32, as shown in a cross-sectional view taken along lines B-B of FIG. **5*a* parallel to the cutting plane surface 69 of die 68. Blanking punch 32 and inserting punch head 34, which is nested within cavity 50, have generally circular cross sections. The outer arcuate wall of inserting head 34 is spaced inwardly from the inner arcuate sidewall of blanking punch 32 to permit sliding axial movement of head 34 within punch 32. Inserting head shaft 48 is secured to head 34 and has vacuum passageway 66 extending along its axis. Blanking punch 32 includes an outer shoulder 47 extending substantially about the periphery of punch 32 and includes cutting edge 46 extending about the periphery of punch 32 on shoulder 47**.

FIG. 7 further illustrates projecting finger portion 52 of blanking punch 32 extending radially outwardly from the axis of punch 32 along a segment of the periphery of punch 32. Finger portion 52 includes about the periphery of finger 52 an outer shoulder 47 which extends about the periphery of punch 32. Cutting edge 54 on the periphery of shoulder 47 of finger 52 defines the shape of the membrane tab portion to be blanked. Radially aligned with finger 52 of blanking punch 32 is a flat surface 103 of inner arcuate sidewall conforming with flat surface 102 on outer arcuate sidewall of inserting head 34 and spaced parallel therefrom.

In FIG. 3, blanked membrane 60 with an integral tab portion 62 is shown folded to an intermediate reverse folded position and releasably secured to the face of inserting head 34, preferably, by vacuum means. Openings 64 on the face of inserting head 34 are interconnected to a vacuum source, such as vacuum pump 44, via passageway 66 extending along the axis of inserting head shaft 48.

FIG. 3 further illustrates blanking, folding and inserting station 24 with an antirotation key 45 on the upper end of punch support shaft 38 above punch support plate 30. Though the location of antirotation key 45 is not critical, it is preferred that key 45 be used as a means to securely align punch 32 and its projecting finger 52 circumferentially with cutting edge 70 of base blanking die 68 to prevent undesired rotation of shaft 38. Key 45 can be screwed into a tapered keyway in shaft 38, for example. Alternatively, other embodiments within the scope of the invention may include an outrigger shaft 99 adjustably attached to shaft 38 by arm 100, as showm in FIGS. 2 and 4. Outrigger shaft 99 is aligned parallel to the axes of shafts 38 and 48 and is slidably arranged within its own preloaded ball bearing bushing 101. Punch 32 and its projecting finger 52 can be circumferentially aligned with cutting edge 70 and held in position by securing arm 100 to outrigger shaft 99 and punch support shaft 38. Also, punch support shaft 38 may be slidably arranged within its own ball bearing bushing **31*a***.

As shown in FIG. 3, it is preferred to have the axes of punch support shaft 38 and blanking punch 32 oriented substantially vertically with the blanking and inserting operations being accomplished as the punch moves vertically downward. Alternative embodiments may also be used within the scope of the present invention. For example, the punch support shaft 38 and blanking punch 32 may be oriented with the axes substantially horizontal or at an angle somewhere between the vertical and horizontal. Furthermore within the scope of the present invention, machine 10 may also include arrangements such that the punch support shaft 38 and punch 32 move upwardly during the blanking, folding and inserting operation. Similarly, punch support plate 30, stripper plate 36, foil stock 18 and conveyor 20, preferably, are substantially horizontal but alternative arrangements are within the scope of the present invention.

Blanking, folding and inserting station 24 further includes blanking die 68 having a cutting edge 70 extending around the periphery of the die opening which is in the shape of membrane 60 (with integral tab portion 62) to be blanked. Upper planar surface 69 of die 68 contacts the underside of foil stock 18 to provide support to the foil stock in the cutting plane during blanking of the membrane by punch 32. Preferably, station 24 further includes a tab folding cam 72 as a second means for folding the blanked tab to an intermediate reverse folded position. Preferably, cam 72 is stationary and aligned below finger portion 52 of blanking punch 32 and includes a generally arcuate and convex camming surface 74. With reference to FIG. 5*d*, cam surface 74, preferably, has a substantially planar first stage horizontal section "d" aligned below the planar first stage section "a" of finger 52 of punch 32 farthest from the axis of punch 32. The planar section "d" merges into a downwardly curving convex second stage section "e" closer the axis of punch 32. The convex section "e" merges downwardly into a vertical third stage section "f" closest to the axis of punch 32. Preferably, third stage section "f" includes a vertical flat surface 90.

Though the preferred embodiment of the present invention includes arcuate surfaces of projecting finger portion 52 of punch 32 and of tab folding cam 72, alternative embodiments of the present invention may include other than the described arcuate concave and convex surfaces. It is within the scope of the present invention that camming surface 56 of finger portion 52 and camming surface 74 of tab folding cam 72 cooperate to fold tab portion 62 of membrane 60 to at least an intermediate reverse folded position.

An alternative embodiment of the tab folding camming surfaces of FIG. 3 are shown in the cross-sectional view of FIG. 4. As in FIG. 3, blanking punch 32*a* is shown in a full down position below the plane of foil stock 18. Blanking punch 32*a* includes a projecting finger portion 52*a* having a camming surface 56*a*. Camming surface 56*a* is generally arcuate and convex. A first stage planar section of surface 56*a* farthest from the axis of punch 32*a* is substantially planar and parallel to foil stock 18. The first stage planar section "g" merges into a convex second stage section "h" which merges into a planar third stage section "i" inclined upwardly away from the cutting plane for portions of the camming surface closest to the axis of blanking punch 32. Furthermore, aligned below finger portion 52*a* is a tab folding body 82 having a tab folding arm 84 projecting therefrom. Body 82 is pivotally mounted to die 68, for example, for rotating about point 86 on body 82. By the action of biasing means 85, body 82 may facilitate folding of the tab to at least an intermediate reverse folded position. Biasing means 85 may be a spring or other device. Blanking and folding of the tab may be initiated by cam surface 56*a* or finger 52*a*. In cooperation with finger 52*a*, further tab folding is initially facilitated by body 82 and arm 84 held in position by biasing means 85 in a pre-stressed or preloaded state. Subsequent to folding the tab to the desired reverse folded position, body 82 rotates about pivot point 86, further stretches spring 85 and moves arm 84 away from the face of punch 32*a* to permit downward movement of punch 32*a* to facilitate insertion of the blanked membrane into covercap 76.

At the lower end of blanking die 68, FIG. 3 illustrates an area of reduced diameter at shoulder 96 overlying a portion of covercap 76 on conveyor 20. The diameter of shoulder 96 should be large enough to accommodate the movement therethrough of insertion head 34 with blanked membrane 60 thereon; however, the diameter should be less than the largest outside diameter of covercap 76 to facilitate removal of covercap from inserting head 34 after blanked membrane 60 is inserted into the covercap. Shoulder 96 may extend substantially about the entire periphery of the lower portion of blanking die 68. At the area on the periphery where the vertical third stage section "f" of tab folding cam 72 is located, the surfaces of shoulder 96 and vertical flat surface 90 of section "f" of cam 72 are contiguous and equidistant from the axis of blanking die 68 to form a flat die surface for folding tab 62 of membrane 60.

Figure 8:
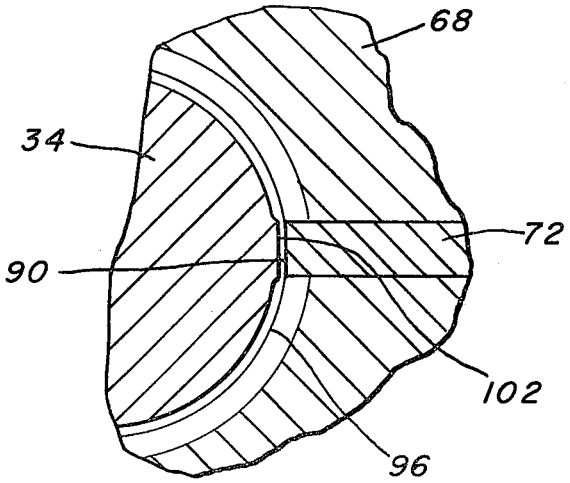
FIG. 8 is a cross-sectional view of a portion of the inserting punch of FIG. 5*d*.

Further illustrated in FIG. 8 is the relationship of tab folding cam 72 and inserting punch head 34 in a down position during the inserting step, as shown in the cross-sectional view taken along lines C—C of FIG. 5*d* parallel to the cutting plane surface and conveyor 20*a*. Inserting punch head 34 and shoulder 96 of die 68 have generally circular cross-sections. The outer arcuate wall of inserting head 34 is spaced inwardly from the inner arcuate sidewall of shoulder 96. Flat surface 102 of inserting head 34 is spaced from and parallel to vertical flat surface 90 of tab folding cam 72. As illustrated, shoulder 96 includes an arcuate sidewall merging into a flat surface which is contiguous with flat surface 90 of cam 72 of die 68.

FIG. 3 illustrates covercap 76 lying on conveyor 20 and aligned with the opening in die 68 below blanking punch 32 and inserting head 34. Station 24 includes cap stop finger 40 which stops the movement of covercap 76 by conveyor 20 under station 24 and facilitates alignment of the covercap below punch 32. Cap stop finger 40 is movable into and out of position to stop covercaps being carried by conveyor 20. Further details of cap stop finger 40 are shown in FIG. 6 which is a schematic plan view of a cap stop oscillator 43 of the present invention.

Figure 6:
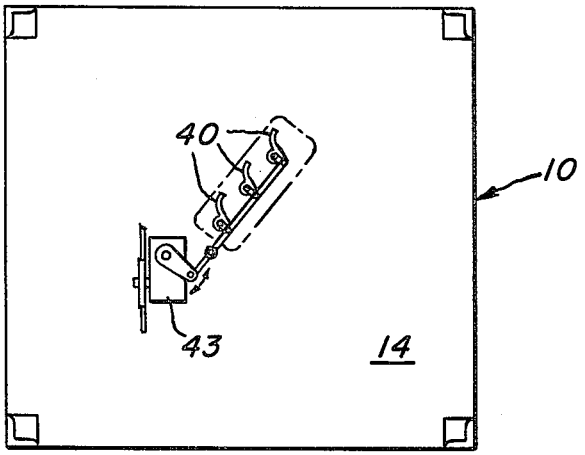
FIG. 6 is a plan view of an alternative feature of the present invention.

FIG. 6 shows a plurality of cap stop fingers 40 mechanically connected in parallel to cap stop oscillator 43 by a linkage rod, for example. Movement of the linkage can cause all the cap stop fingers 40 to move simultaneously in a direction into the path of covercaps moving on conveyor 20 to stop covercaps 76. Opposite movement can cause all cap stop fingers 40 to move simultaneously away from covercaps 76 and out of the path of covercaps so as to be carried along conveyor 20.

FIG. 3 also illustrates conveyor vacuum duct 78 subjacent to and in contact with conveyor belt 20. The purpose of conveyor duct 78 is to increase the frictional contact of the covercap 76 against conveyor belt 20 to facilitate quicker movement of covercap 76 from station 24 after cap stop finger 40 moves out of the path of the covercap along conveyor 20. The increase in frictional contact can be the result of openings 79 in vacuum duct 78. Drawing a vacuum by pulling the air across conveyor belt 20, through openings 79 and through vacuum duct 78, temporarily secures covercap to belt 20. Movement of finger 40 away from covercap 76 permits covercap 76 to be readily carried by conveyor belt 20 from beneath station 24.

An alternative, and preferred arrangement for moving a covercap into station 24 and for stopping and aligning covercap 76 below punch 32 is shown in FIG. 4. Conveyor belt 20*a* may include pockets or recesses 21 for receiving and holding covercaps during the membrane blanking, folding and inserting operations. Conveyor 20*a* is indexed or synchronized with those operations in order to move a covercap into aligned position with blanking punch 32*a*, to hold the covercap in position until a membrane has been inserted and thereafter to move the covercap away from blanking punch 32*a* and out of station 24. In such a preferred embodiment, conveyor belt 20*a* moves incrementally to sequentially bring successive covercaps into station 24 with the duration of the intermittent stops determined by the time allowed to blank, fold and insert a membrane into a covercap.

FIG. 3 further illustrates tab embossing tool 98 located in base die 68 upstream of cutting edge 70 of die 68 and blanking punch 32. Embossing tool 98 includes an embossing blade 80 for marking tab fold lines on the foil stock at the perimeter of the disc portions of membranes yet to be blanked. As shown in FIG. 3, embossing blade 80 projects slightly from upper cutting surface 69 of blanking die 68 to mark a tab fold line. Preferably, blade 80 is fixed in position projecting slightly above cutting surface 69. Alternatively, embossing blade 80 can be mechanically or pneumatically actuated to project from surface 69 to emboss a fold line and to thereafter retract or partially retract. For example, embossing blade 80 may be spring loaded so as to be pressed into a partially retracted position by stripper plate 36 after embossing a fold line.

Preferably, embossing blade 80 cooperates with groove or notch 73 on lower surface 71 of stripper 36, as shown in FIG. 3. Groove 73 should have a shape conforming to or compatible with the contour of embossing blade 80 for receiving therein blade 80 for marking a tab fold line on foil stock 18 sandwiched between blade 80 and groove 73. Preferably, embossing tool 98 is located adjacent blanking die 68 of station 24 for marking a tab fold line on foil stock 18 for the next succeeding foil membrane to be blanked. Though embossing tool 98 may be located farther upstream from blanking die 68, it is preferred that embossing tool 98 be immediately adjacent blanking die 68 for maintaining the accuracy of locating the fold line. The accuracy may be diminished when tool 98 is located farther away from the axis of punch 32 and blanking die 68.

Alternatively, embossing blade 80 of embossing tool 98 cooperates with groove or notch 73 on lower planar surface 105 of embossing wing 104 of blanking punch 32*a*, as shown in FIG. 4. Embossing tool 98 is located immediately adjacent station 24 for marking a tab fold line on foil stock 18 for the next succeeding foil membrane to be blanked. Wing 104 projects laterally from the main body of blanking punch 32*a* such that lower surface 105 contacts with top surface 69 of blanking die 68 about the time punch 32 completes blanking of a membrane. Groove 73 should have a shape conforming to or compatible with the contour of embossing blade 80 for receiving therein foil stock 18 forced by blade 80 for marking a tab.

The use and operation of the present invention can better be understood by reference to FIGS. 1 and 3 the schematic illustration of FIGS. 5*a–d* which show the sequence of blanking membrane 60 with tab portion 62 from foil stock 18, folding tab 62 and inserting membrane 60 with folded tab 62 into covercap 76. FIG. 1 illustrates foil stock 18 being supplied through roll feed device 16 by a pushing action to subassembly 12 having multiple blanking, folding and inserting stations 24. Air conveyor 26 located downstream of stations 24 facilitates movement of foil stock 18 from roll feed device 16 through stations 24 to scrap container 28. Air conveyor 26 exerts a pulling action on foil stock 18 from which membranes have been blanked. The pulling action is generally preferred in order to facilitate feeding of foil stock 18 which is very thin. Typically, foil stock 18 includes a laminate of metal foil with a plastic film on opposite surfaces of the metal. For example, foil stock 18 may have 0.0015 inch (0.038 mm) metal foil with 0.002 inch (0.051 mm) plastic film on one surface and 0.001 inch (0.025 mm) plastic film on the other surface, for a composite thickness of 0.0045 inch (0.114 mm). Such thin foil stock is fragile and can be more easily fed to subassembly 12 without creasing, wrinkling, tearing or binding by roll feed device 16 and air conveyor 26.

Conveyor 20 supplies the covercaps to stations 24. FIG. 1 further illustrates conveyor 20 transverse to the direction of feed of foil stock 18. While such arrangement is the preferred embodiment of the present invention, other embodiments may include plan view arrangements where cap conveyor 20 and foil stock 18 are for example, parallel or perpendicular. In some instances, cap conveyor 20 may be parallel to the foil stock with the supply of covercaps moving in a direction opposite to the supply of foil stock 18. The preferred embodiment, however, illustrates a compact design in plan view where multiple stations 24, in this case three stations, are oriented with their centers substantially diagonally traversing foil stock 18 substantially perpendicular to covercap supply conveyor 20.

Covercaps 76 are brought into position within station 74 and aligned with blanking punch. The embodiment of conveyor 20 may be as shown in FIG. 3 wherein cap stop finger 40 stops and aligns a covercap being carried on moving conveyor 20. Finger 40 is moved into covercap stopping position by oscillator 43 (shown in FIG. 6) which may be synchronized with the commencement of the downward stroke of blanking punch 32 of station 24. Preferably, conveyor 20a of FIG. 4 with pockets 21 thereon carry covercaps into and out of position. The movement of conveyor 20a is incremental and indexed or synchronized, such as with the commencement of the downward stroke of blanking punch 32.

Embossing tool 22 for marking designs, symbols or wording on membranes may also be synchronized with the stroke of blanking punch 32. Tools 22 may be located between roll feed device 16 and station 24 for marking foil stock 18 before blanking. The proximity of embossing tools 22 with respect to stations 24 may depend upon the desired accuracy of the embossments on membranes yet to be blanked. The closer the proximity, the more accurate may be the location of the embossin. Embossing tools 22 may mark foil stock 18 at a location which is the next succeeding membrane to be blanked or which is a latter succeeding membrane to be blanked.

During feeding of foil stock 18 into station 24, blanking punch 32 is in a retracted position, shown by dotted line 58, above the plane of foil stock 18 and cutting surface 69 of blanking die 68. Furthermore, movable stripper plate 36 is spaced above and apart from cutting surface 69 to permit foil stock 18 to be fed into station 24. The upward retracted position of stripper plate 36 is accomplished by upward travel of stripper plate support shaft 36 in synchronization with the supply of foil stock 18 fed by roll feed device 16. Such upward positioning of stripper plate 36 separates lower surface 71 of plate 36 from upper cutting surface 69 of blanking die 68 and compresses spring 41 on support shaft 35 of stripper plate 36.

When covercap 76 is aligned below punch 32 of station 24, blanking punch 32 (and inserting head 34 nested therein) commences its downward stroke by the sliding action of punch support shaft 38 in support shaft bearing 31. Simultaneously, stripper plate 36 moves downwardly with punch 32 by the forcing action of compressed spring 41 until it contacts cutting surface 69 of die 68. Such contact results in the embossment of fold line 88 on foil stock 18 for the next membrane to be blanked. Embossing blade 80 of tab embossing tool 98 is forced in groove 73 on the lower surface 71 of stripper plate 36 (as shown in FIG. 3) with foil stock 18 squeezed between blade 80 and groove 73.

Figure 5A:
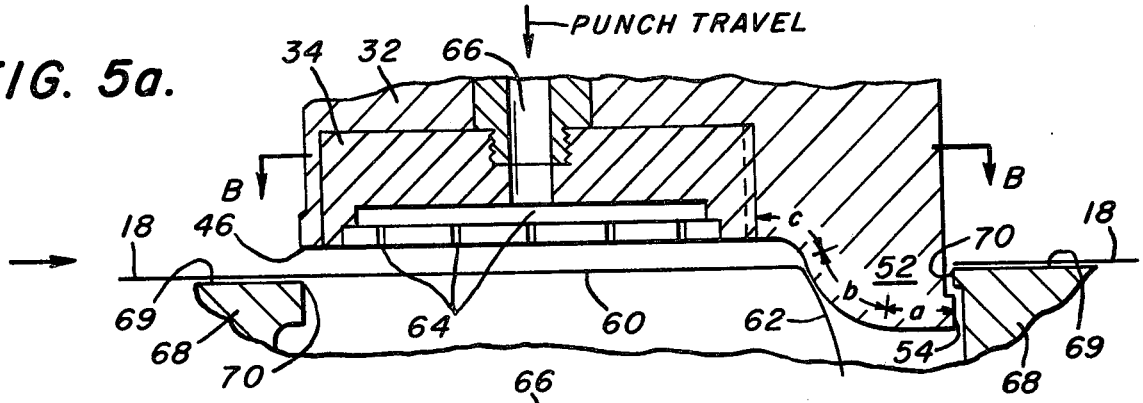
FIGS. 5*a* through 5*d* are schematics of the blanking, folding and inserting operation sequence.

In FIG. 5*a*, blanking punch 32 is illustrated in a partial downward stroke after initiating blanking by initiating cutting of tab 62 by the cooperation of cutting edge 54 of projecting finger portion 52 with cutting edge 70 in cutting plane surface 69 of die 68. Inserting head 34 is still nested completely within cavity 50 of blanking punch 32. During tab blanking, a vacuum is being drawn from a vacuum source through interconnected passageways and openings 64 via passageway 66 in shaft 48 to releasably hold membrane 60 to the punch face. While the tab is being blanked, contact between the tab 62 and camming surface 56 of projecting finger 52 begins to fold the tab progressively downward. As shown in FIG. 5*a*, tab 62 is partly reverse folded and is in contact with second stage convex section "b" of finger 52. Cutting edge 46 of blanking punch 32 is above the plane of and has not yet contacted foil stock 18.

Figure 5B:
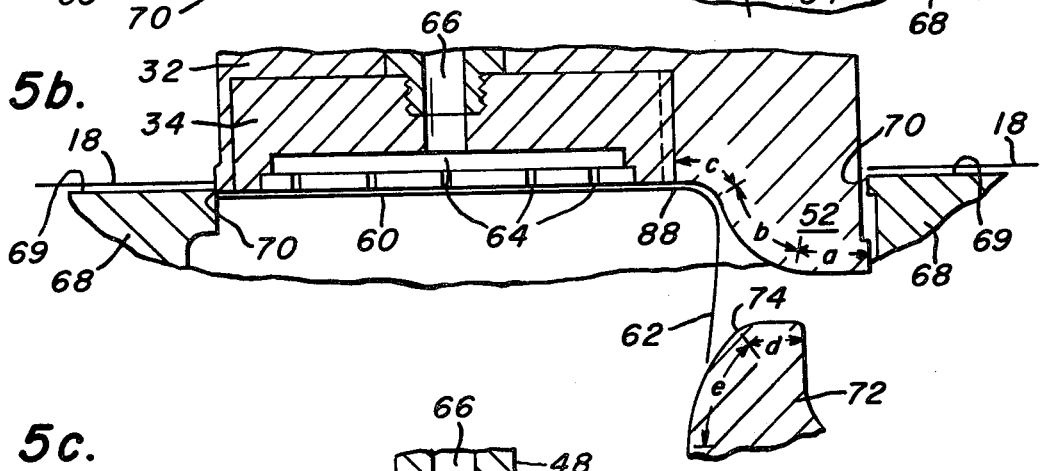

FIG. 5b shows blanking punch 32 after further downward movement where cutting edge 46 in cooperation with cutting edge 70 of die 68 has blanked entire membrane 60 from the foil stock 18. Inserting head 34 remains nested within blanking punch 32. The vacuum being drawn through interconnected passageway 66 with openings and passageways 64 on the face of inserting head 34 nested within blanking punch 32 keeps membrane 60 releasably secured to the face of the punch. FIG. 5*b* further shows that tab 62 has been bent farther downwardly as it followed camming surface 56 of projecting finger 52 and contacts concave third stage section "c" of finger 52 until the tab is bent along fold line 88 on membrane 60. Fold line 88 is located at the intersection of the periphery of the disc portion of the membrane with the tab portion 62. With respect to blanking punch 32 and inserting head 34, the fold line is generally aligned at the edge formed by the face of inserting head 34 and flat surface 102 of inserting head 34 at the interface of inserting head 34 and punch 32. A short distance below cutting plane 69 of die 68, the downward movement of blanking punch 32 ceases while inserting head 34 continues moving axially downward from cavity 50 of punch 32 with the blanked membrane 60 releasably secured to the face thereof.

Figure 5C:
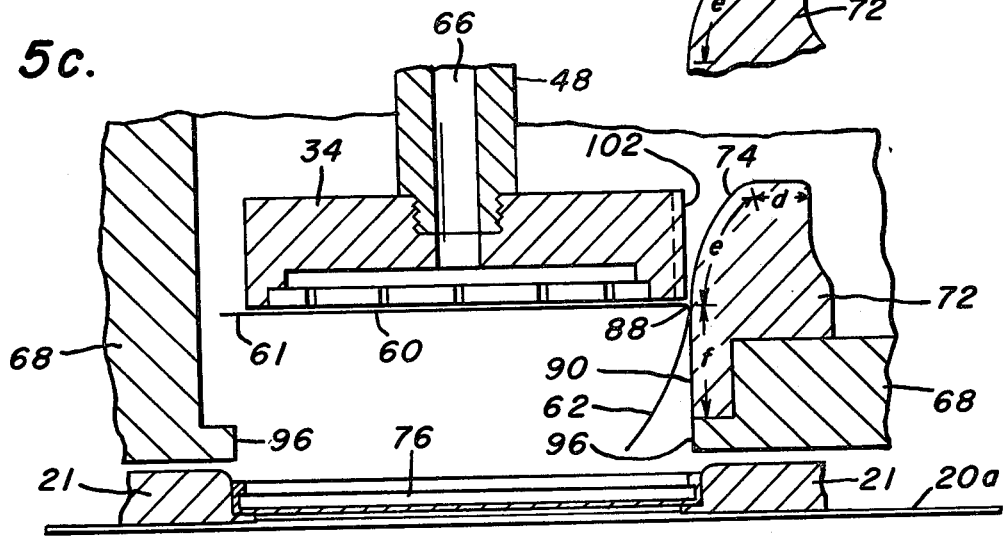
Figure 5D:
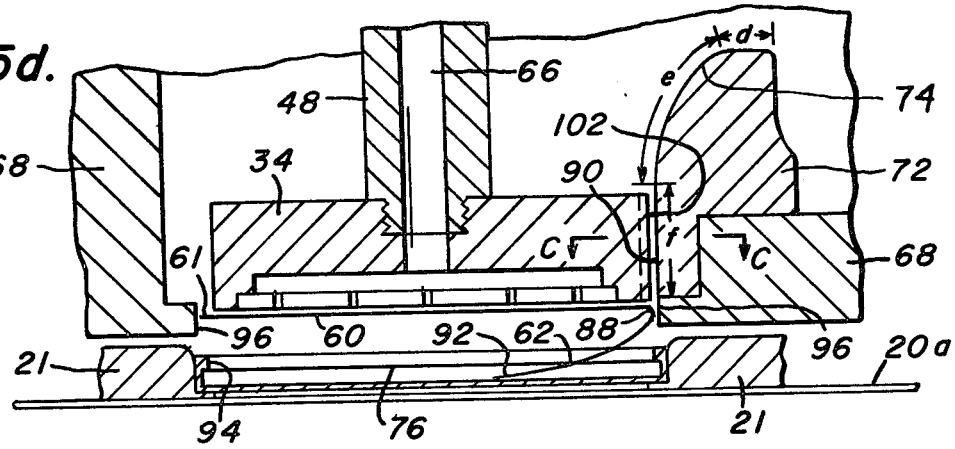

In FIG. 5*c*, inserting head 34 is shown in a further downward position of its stroke after it has moved axially out of cavity 50 of blanking punch 32 by the sliding action of shaft 48 within punch support shaft 38. Tab 62 is shown folded farther inwardly and downwardly to an intermediate reverse folded position by the further camming action of camming surface 74 of tab folding cam 72 against tab 62. Third stage vertical section "f" of cam 72 and substantially vertical flat sidwall 90 are parallel with flat surface 102 on outer wall portion of inserting head 34 and inner wall portions 96 of die 68. Membrane 60 is substantially disc shaped with tab 62 bent inwardly and downwardly. Inserting head 34 is shown adjacent the vertical cylinder sidewall portions 90 of cam 72 with blanked foil membrane 60 contacting the sidewall 90 (and third stage section "f" of cam 72) along tab 62 near fold line 88 to progressively and continually fold or bend tab 62 at fold line 88 to at least an intermediate reverse fold position. Covercap 76 is aligned below inserting head 34 by pockets 21 on conveyor 20*a*.

FIG. 5*c*, as well as FIG. 3, shows portion 61 of membrane 60 projecting laterally past the sidewall of inserting head 34 diametrically opposite that portion of head 34 adjacent cam 72. The existence and extent of projecting membrane 61, which would extend substantially about the periphery of membrane 60 and which depends on the particular design of inserting head 34 and blanking punch 32, is not critical to the present invention. The projecting membrane 61 results from the difference in diameters of inserting head 34 and punch 32. For example, however, if the face of inserting head 34 is designed to be the same size as punch 32, there would be no membrane projection. Membrane 60 does not project past the sidewall of inserting head 34 near folded tab 62 because of the contact of tab 62 with cam 72 for accurate folding along line 88.

FIG. 3 illustrates station 24 having blanking punch 32 in a position at the end of its downward stroke subsequent to blanking the membrane 60. Inserting head 34 is shown in a farther downward position of its stroke between that illustrated in FIGS. 5*c* and 5*d* with tab 62 bent along the fold line to an intermediate reverse folded position. In FIG. 3, tab 62 is contacting vertical flat sidewall 90 of cam 72 which facilitates folding tab 62 in an intermediate reverse folded position. End 92 of tab 62 is shown just making contact with the interior of covercap 76. FIG. 3 also shows that embossing tool 98 and blade 80 against the underside of foil stock 18 to emboss a fold line on foil stock 18 at a position that will be the fold line between the disc portion and integral tab portion of a membrane yet to be blanked.

In FIG. 5*d*, inserting head 34 is shown farther down in the stroke with membrane 60 releasably secured to the face thereof by the vacuum means. Tab 62 is shown farther bent to a reverse folded position by the contact with the interior surface of covercap 76 at or near tab end 92 which is the end farthest from the fold line and disc portion of membrane 60. Farther downward displacement of inserting head 34 will further press tab 62 between the disc portion of membrane 60 and the interior surface of covercap 76 until tab 62 is in a completely reverse folded position and until membrane 60 is inserted past shoulder 94 of covercap 76.

After insertion into covercap 76, membrane 60 will be released from the face of inserting head 34 by releasing or decreasing the vacuum being drawn through passages 64 and 66. After release of membrane 60, inserting head 34 will begin to retract and move vertically upwardly towards cavity 50 by the sliding motion of shaft 48 within punch shaft 38 in order to nest in blanking punch 32. During retraction of head 34, the complete closure assembly of covercap 76 with membrane 60 may remain attached to the periphery of inserting head 34 due to the frictional contact of the inner sidewalls of cap 76 with the outer sidewalls of inserting head 34. When inserting head 34 retracts upwardly through die 68, covercap 76 is stripped from inserting head 34 by shoulder 96 of die 68 having a diameter smaller than the outside diameter of covercap 76. Closure assembly of covercap 76 remains on conveyor 20 to be moved to a collection site. Stripping of covercap 76 from inserting head 34 can be further facilitated when the embodiment of conveyor 20 includes the vacuum duct 78 and openings 79, as shown in FIG. 3. The vacuum means tends to hold covercap 76 on conveyor belt 20 as inserting head 34 retracts.

Inserting head 34 further retracts upwardly to nest in cavity 50 of blank punch 32. Punch 32 and inserting head 34 then axially travel together upwardly to a retracted position above the plane of foil stock 18, as shown by dotted line 58 in FIG. 3. As blanking punch 32 travels upwardly through the plane of foil stock 18, stripper plate 36 strips foil stock that tends to remain attached to blanking punch 32 due to the frictional contact with the outer wall of punch 32. Blanking punch 32 retracts upwardly above the cutting plane 69 of die 68 to its upper position 58. Stripper plate 36 also moves upwardly until spaced above cutting plane 69 of die 68 by the lifting action of shaft 35.

Roll feed device 16 then incrementally feeds foil stock 18 into the punch area of station 24 facilitated by air conveyor 26 pulling scrap foil stock 18 out of station 24 and into scrap box 28. The foil stock 18 is fed into the punch area so that fold line 88, marked by embossing tools 98, is accurately located at the interface of inserting head 34 and punch 32 at flats 102 and 103 and at the periphery of the disc portion of the soon to be blanked membrane. The blanking, folding and inserting machine 10 is then set for another cycle.

As was the object of the present invention, a method and apparatus is provided for blanking foil membranes with integral pull tabs by blanking and folding the tab, and blanking and inserting the entire membrane into a plastic cap in one continuous press stroke. In accordance with the invention, closure assemblies can be manufactured anywhere from 50 to 75% faster than prior art methods and apparatus. The present apparatus may operate at or about 200 strokes per minute per punch such that for a three-station apparatus as described in the prefered embodiment, 600 closure assemblies per minute can be produced. The present invention provides an automatic and less complex machine than has been shown in the prior art.

Although preferred embodiments and alternative embodiments have been described, it will be apparent to one skilled in the art that changes can be made therein without departing from the scope of the invention.

What is claimed is:

1. A method of making a closure assembly having a foil membrane and covercap suitable for induction heat sealing the membrane about a container mouth, the method comprises:

(a) providing a membrane having a disc portion and an integral tab portion from foil stock by initiating blanking of the tab portion and then folding the tab portion as it is being blanked to progressively reverse fold the tab portion toward the disc portion along a line at the periphery of the disc portion and continuing to fold the tab portion to at least an intermediate reverse folded position as the disc portion is blanked;

(b) inserting the blanked membrane into the covercap and thereby further reverse folding the tab portion between the disc portion and covercap by contacting the partially folded tab portion near its end farthest from the fold line with the interior of the covercap and thereafter pressing the tab portion between the disc portion and covercap to fold the tab portion; and (c) said blanking and inserting of the membrane being accomplished in one continuous axial stroke.

2. A method as set forth in claim 1 wherein multiple foil membranes are blanked and inserted into a corresponding number of covercaps simultaneously.

3. A method as set forth in claim 1 further including incrementally feeding foil stock and covercaps to successively blank membranes from the foil stock into successive covercaps.

4. A method as set forth in claim 1 wherein blanking and inserting the membrane into the covercap further includes simultaneously embossing a fold line on the foil stock for a tab at the periphery of a disc portion for a succeeding foil membrane to be blanked.

5. A method as set forth in claim 1 further includes drawing a vacuum to hold the blanked membrane for insertion into the covercap and thereafter releasing the vacuum after insertion.

6. A method of making a closure assembly having a foil membrane and plastic covercap suitable for the membrane to be induction heat sealed about a container mouth, the method comprises:

(a) blanking a membrane having a disc portion and an integral tab portion from foil stock by initiating blanking of the tab portion from the tab portion end farthest from the disc portion before blanking the disc portion, said disc portion blanking includes progressive downward reverse folding of the tab portion along a fold line at the periphery of the disc portion to at least an intermediate reverse folded position with the tab portion end generally underlying the disc portion;

(b) inserting the blanked membrane into a covercap generally underlying the foil stock and aligned with the blanked membrane, said inserting includes further folding of the tab portion to a reverse folded position between the membrane disc portion and covercap by pressing the partially folded tab portion near its end farthest from the fold line against the interior of the covercap until the tab portion is reverse folded and the membrane is inserted into the covercap; and (c) embossing a fold line on the foil stock for a tab at the periphery of the disc portion of a succeeding foil membrane to be blanked.

7. An apparatus for making a closure assembly having a foil membrane and covercap, the apparatus comprises:

(a) a punch for blanking from foil stock a membrane with a disc portion and an integral tab portion, the punch including a projecting finger portion for blanking the membrane tab portion, the finger portion extends laterally from a portion of the punch used to make the membrane disc portion and projects outwardly from a face of the portion of the punch used to make the membrane disc portion to initiate blanking of the tab portion before blanking of the disc portion, said finger portion includes a camming surface on its face for progressively reverse folding the tab portion in a direction toward the portion of the punch used to make the membrane disc portion and along a line joining the tab portion and disc portion of the membrane at the periphery of the membrane disc portion;

(b) means for reversely folding the tab portion in a direction toward the portion of the punch used to make the membrane disc portion to an intermediate reverse folded position, said means aligned with the punch finger portion for cooperation with the camming surface of the punch face to facilitate progressive folding of the tab portion; and (c) means for inserting the blanked membrane into a covercap, said means including an insertion head arranged within the blanking punch for axially traveling from the face of the blanking punch for inserting the blanked membrane into the covercap and thereby pressing the partially folded tab portion between the membrane disc and covercap to form a reverse fold, said head portion having a means for releasably holding the membrane thereto during insertion into the covercap.

8. An apparatus as set forth in claim 7 wherein the finger portion includes an arcuate cam surface for initiating folding of the tab portion.

9. An apparatus as set forth in claim 7 wherein the means for folding includes an arcuate cam surface merging into a planar surface generally parallel to the punch axis.

10. An apparatus as set forth in claim 7 wherein the folding means includes a pivotal tab folding body against which the tab portion contacts for reversely folding the tab portion and which pivots out of the path of the insertion head during its axial travel.

11. An apparatus as set forth in claim 7 wherein the means for releasably holding the membrane on the insertion head portion includes vacuum means on the face of the head.

12. An apparatus as set forth in claim 7 further including means for embossing a fold line on the foil stock for a tab at the periphery of a disc portion of a succeeding membrane to be blanked simultaneously with blanking and inserting a membrane into a covercap.

13. An apparatus as set forth in claim 7 further including multiple punches arranged for simultaneously blanking and inserting membranes for multiple closure assemblies.

14. An apparatus as set forth in claim 7 further including a roll feed device for supplying foil stock to the punch.

15. An apparatus as set forth in claim 14 wherein the roll feed device incrementally feeds foil stock to the punch as successive membranes are blanked.

16. An apparatus as set forth in claim 7 further including a conveyor means for supplying covercaps to the punch area for receiving blanked membranes.

17. An apparatus as set forth in claim 16 wherein conveyor means incrementally provides covercaps synchronized with the blanking punch and the inserting head.

18. An apparatus as set forth in claim 16 wherein conveyor means further includes a covercap stop means for stopping and aligning a covercap for insertion of a blanked membrane and for thereafter releasing the covercap closure assembly on the conveyor means.

19. An apparatus as set forth in claim 7 wherein the blanking punch travel ceases after blanking the membrane and the inserting head axially travels from the punch face to insert the membrane into the covercap.

20. An apparatus for making a closure assembly having a foil membrane and cover cap, the apparatus comprises:

(a) a punch for blanking a membrane with a disc portion and an integral tab portion from foil stock;

(b) means for feeding foil stock to the punch;

(c) means for conveying covercaps to the punch, said means being substantially parallel to the plane of the foil stock at the punch location with said foil stock lying between the punch face and conveyor means prior to blanking;

(d) said punch including a projecting finger portion for blanking the membrane tab portion, the finger portion extending laterally from a portion of the punch used to make the membrane disc portion and outwardly from a face on the portion of the punch used to make the membrane disc portion to initiate blanking of the tab portion before blanking the disc portion, said finger portion includes a camming surface on the punch face for progressively folding the tab portion in a direction toward the portion of the punch used to make the membrane disc portion and along a fold line joining the tab portion and disc portion of the membrane at the periphery of the membrane disc portion;

(e) means for reversely folding the tab portion in the direction toward the portion of the punch used to make the membrane disc portion to an intermediate reverse folded position, said means aligned with the punch finger portion for cooperation with the camming surface of the punch finger to facilitate progressive folding of the tab portion as the punch travels during blanking;

(f) means for inserting a blanked membrane disc with an intermediate reverse folded tab into a covercap, said means including an insertion head slidably arranged within the blanking punch for axial travel from the punch toward the covercap to press the intermediate reverse folded tab portion against the covercap interior wall during insertion of the membrane into the covercap with the tab portion reverse folded between the covercap and membrane;

(g) means on said insertion head for releasably holding the blanked membrane and thereafter releasing the membrane after insertion into the covercap; and (h) means for embossing a fold line on foil stock for a membrane tab portion at the periphery of the membrane disc portion of a succeeding membrane to be blanked, simultaneously with blanking and inserting a membrane into a covercap.

* * * * *